US006469432B2

(12) United States Patent
Suzuki et al.

(10) Patent No.: US 6,469,432 B2
(45) Date of Patent: Oct. 22, 2002

(54) CATHODE-RAY TUBE HAVING ELECTRODE WITH ANGLED OUTSIDE APERTURE

(75) Inventors: Yuuichi Suzuki; Hirotsugu Ishihara; Makoto Baba, all of Kanagawa (JP)

(73) Assignee: Sony Corporation (JP)

( * ) Notice: Subject to any disclaimer, the term of this patent is extended or adjusted under 35 U.S.C. 154(b) by 46 days.

(21) Appl. No.: 09/756,914

(22) Filed: Jan. 10, 2001

(65) Prior Publication Data

US 2001/0007409 A1 Jul. 12, 2001

(30) Foreign Application Priority Data

Jan. 11, 2000 (JP) ..... 2000-002832

(51) Int. Cl.[7] ..... H01J 29/70
(52) U.S. Cl. ..... 313/427; 313/491; 313/631
(58) Field of Search ..... 313/414, 427, 313/447, 458, 491, 631

(56) References Cited

FOREIGN PATENT DOCUMENTS

| | | |
|---|---|---|
| JP | 4061588 | 2/1992 |
| JP | 8222149 | 8/1996 |
| JP | 9245667 | 9/1997 |

*Primary Examiner*—Vip Patel
(74) *Attorney, Agent, or Firm*—Rader, Fishman & Grauer PLLC; Ronald P. Kananen, Esq.

(57) ABSTRACT

A cathode-ray tube according to the present invention is able to automatically correct a color shading caused due to a repulsion effect and the like, which occurs between electron beams. An electron gun for use with the cathode-ray tube according to the present invention includes beam apertures bored through a first electrode opposing a cathode disposed in an inline fashion. Further, beam apertures through which so-called side beams pass are bored with a predetermined inclination relative to the opposing cathodes. Consequently, an electron lens formed between the cathode and the first electrode becomes an axial-asymmetric electron lens. The curvature of this electron lens is changed in response to a drive voltage of the cathode. When this curvature is changed, the trajectories of electron beams are changed to cancel an influence caused by a repulsion effect. Thus, a color shading can be corrected automatically.

7 Claims, 12 Drawing Sheets

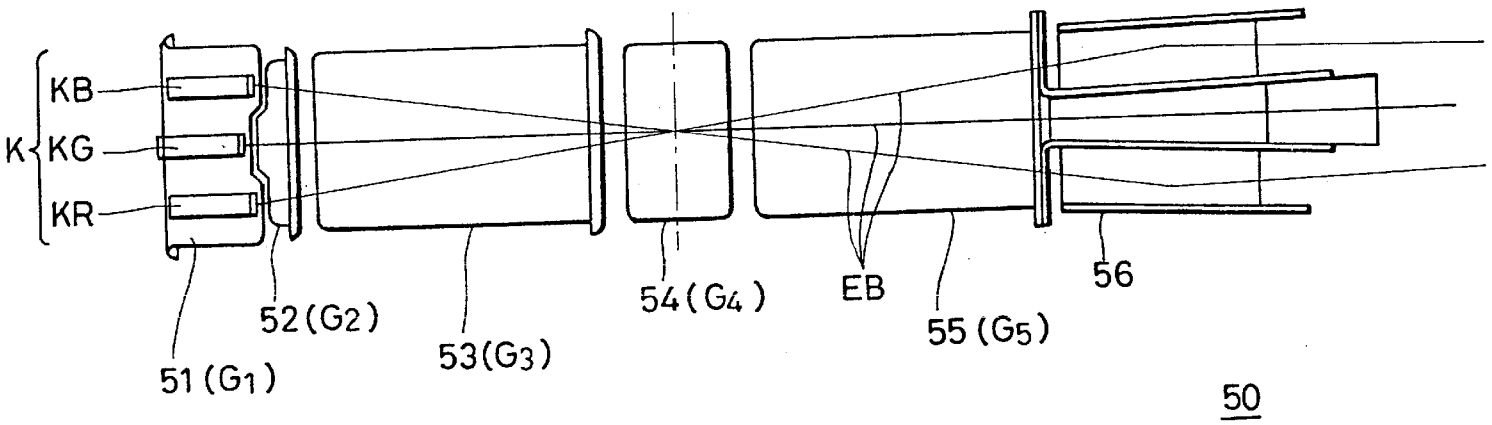
FIG. 1A
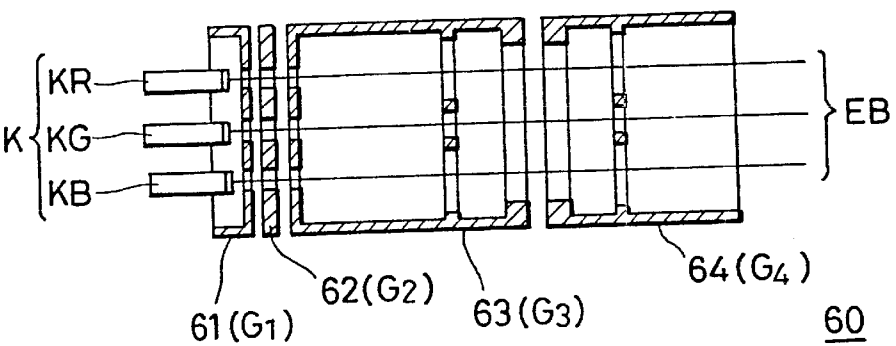
FIG. 1B
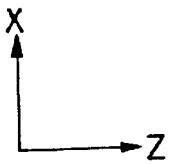

CATHODE-RAY TUBE HAVING ELECTRODE WITH ANGLED OUTSIDE APERTURE

BACKGROUND OF THE INVENTION

1. Field of the Invention

The present invention relates to a cathode-ray tube which includes an electron gun comprising a cathode and a plurality of electrodes and, particularly, to a color cathode-ray tube which includes a a plurality of cathodes corresponding to colors.

2. Description of the Related Art

Heretofore, as an electron gun of a color cathode-ray tube, there has been mainly used an electron gun 50 of a multi-beam single-electron gun system in which a plurality of electron beams EB are intersected with each other within the electron gun and are emitted as shown in FIG. 1A, or an electron gun 60, a so-called inline electron gun of a system in which a plurality of electron beams EB are arrayed substantially in parallel within the electron gun and the electron beams are not intersected with each other within the electron gun and are emitted as shown in FIG. 1B.

In the electron guns 50, 60 of any of the systems, three electron beams EB are generated from three cathodes KR, KG, KB corresponding to a display of the three colors red, green and blue. These electron beams pass through respective electrodes of the electron guns 50, 60 and are introduced into the surface of a fluorescent screen of the cathode-ray tube. These electron beams are introduced into adjacent red, green and blue phosphors.

Specifically, as FIG. 2 shows, an electron gun 73 (50, 60) is disposed in a necked-down portion 72*c* of a cathode-ray tube assembly 72 formed of a glass, for example, of a cathode-ray tube 71. Three electron beams EB are emitted from the electron gun 73. The three electron beams EB travel through a color-selecting mechanism 75, such as a so-called aperture grille, before being incident onto a fluorescent screen 76 formed on the inner surface of a panel portion 72*a* of the cathode-ray tube assembly 72. These electron beams have to be incident on phosphors emitting red, green and blue light, which are adjacent to each other, although not shown.

It has been customary that the trajectories of the two side electron beams should be changed by suitable means, and the three electron beams go into convergence so that the side beams, i.e., two electron beams, e.g., electron beams usually corresponding to a red and blue display, may intersect with each other on the color-selecting mechanism 75 disposed ahead of the fluorescent screen 76 as-seen from the side of the electron gun 73.

In the electron gun 50 of the system shown in FIG. 1A, a convergence plate 56 is disposed between a focus lens of the electron gun and the color-selecting mechanism so that a stationary electric field acts on the side beams to (change the trajectories of the side beams, and thereby the three electron beams establish a convergence.

In the electron gun 60 of the system shown in FIG. 1B, a convergence of a plurality of electron beams is established by various systems.

In general, there is used a system in which a so-called dog-bone-like, large, overlapping electrostatic lens electric field is formed in the X direction (horizontal direction) on a main lens formed between a third electrode 63 (G3) and a fourth electrode (G4). That is, its lens action is used to change the convergence of each of the electron beams EB and the trajectories of the side beams, thereby establishing the convergence.

As another example, there is known a method of changing the trajectories of the side beams by displacing the axes of the side beams between the opposing electrodes.

In any of the above methods, it has been customary that the convergence is established by the action of the electric field.

As a method of changing the amperage of each electron beam current in response to a video signal, there is generally used a so-called cathode-drive system for changing a cathode-drive voltage. Precisely, the amperage of an electron-beam current should be changed in order to change a liminance. The amperage of an electron-beam current can be changed by changing the cathode voltage. Specifically, when the luminance increases, the cathode potential should be decreased. When the luminance decreases, the cathode potential should be increased.

Incidentally, a constant high-voltage potential is applied to the fluorescent screen or electrodes of other electron guns regardless of the change of the cathode potential.

However, the energy of an electron beam passing through the main lens changes in response to the change of the cathode potential so that the velocity of an electron beam changes.

Specifically, when the luminance increases, the cathode potential decreases and the potential difference increases relatively so that the velocity of the electron beam increases. So, the trajectories of the side beams change.

FIGS. 3A and 3B show the manner in which the trajectories of the side beams change as the velocity of the electron beam increases. FIG. 3A shows the case of the electron gun of the system shown in FIG. 1A. FIG. 3B shows the case of the electron gun of the system shown in FIG. 1B.

When the velocity of the electron beam increases as described above, in the convergence plate 56 shown in FIG. 3A, or in the overlapping electrostatic lens formed between the third electrode 63 (G3) and the fourth electrode 64 (G4) shown in FIG. 3B, the sensitivity with which the electron beam changes its trajectory as the electron beam is deflected is lowered.

As a consequence, the trajectory of the electron beam changes, as shown arrows in the figures, with the result that the side beams which are coincident with each other at the color-selecting mechanism 75 are displaced from each other.

When the amperage of the electron beams' currents of red, green and blue increase, a so-called repulsion action influences each electron beam more strongly.

A repulsion action which influences the electron beam 57 for diplaying blue emitted from the cathode KB of the electron gun 50 of the system shown in FIG. 1A will be described with reference to FIG. 4.

The electron beam 57 is influenced by a repulsion action 59 acting on the electron beam from other two electron beams 58 while it travels toward the fluorescent screen 76.

This repulsion action 59 is generated by an electric field acting on the electron beams. The repulsion action 59 becomes strong when the amperage of the respective electron beam's current increases in order to increase the luminance of each color.

While the electron beam 57 is influenced by a repulsion action 59' acting on the electron beams within the electron gun 50, this repulsion action is generally weaker than the repulsion action 59 which influences the blue electron beam between the electron gun 50 and the color-selecting electrode 75.

The above-described two actions, i.e., a decrease in the sensitivity when the trajectory of the electron beam is changed in response to the velocity and the repulsion action, cause misconvergences in the same direction, respectively.

This influence becomes remarkable for an image with a higher luminance, such as a teletext, compared with an ordinary broadcasting, for example. Specifically, a color shading occurs and characters are displayed doubly, which, therefore, causes picture quality to be deteriorated.

As a method of solving this problem, there have been proposed a method of adding an auxiliary electrode (see Japanese laid-open patent application No. 9-245667) and a method of correcting by a magnetic field (see Japanese laid-open patent application No. 4-61588).

However, these methods need circuits by which the amperage of the electron beams' currents for displaying red, green and blue are detected and a voltage applied to the auxiliary electrode or current flowing through a coil disposed outside a necked-down portion is adjusted in response to the change of the amperage of each electron beam current.

Because the frequency of a signal applied to a cathode has a tendency to increase as a cathode-ray tube of a television receiver or the like becomes a high-definition cathode-ray tube, it becomes difficult to correct the trajectories of electron beams in accordance with a change in current amperage.

On the other hand, as proposed in Japanese laid-open patent application No. 8-22149, there is a method in which a coining is provided at the side opposing to a cathode of a first electrode, and the coining is made asymmetric with respect to the axis of the beam aperture of the first electrode by offsetting this coining to the inline arrangement direction.

However, it was confirmed that this method cannot substantially achieve correction effects on the electric-current-level of an electron beam necessary for displaying an ordinary television broadcast.

SUMMARY OF THE INVENTION

In order to solve the above problems, it is an object of the present invention to provide a cathode-ray tube capable of obtaining an excellent picture quality by improving the amount in which a convergence is changed as a luminance is changed.

A cathode-ray tube according to the present invention includes an electron gun emitting a plurality of electron beams. The electron gun has a plurality of cathodes arrayed in-line and a first electrode opposing the cathodes. Beam apertures for respective cathodes are bored on the first electrode. Among the beam apertures, apertures through which so-called side beams pass are characterized by being bored inclined by a predetermined angle relative to the cathodes.

According to the above-described arrangement of the present invention, an electrostatic lens formed between a cathode generating a side beam and the first electrode is axial asymmetric.

When the amperage of a beam current is low, i.e., the cathode potential is high, this electrostatic lens is axial asymmetric and has a large curvature. On the other hand, when the amperage of a beam current is large, i.e., the cathode potential is low, this electrostatic lens is axial asymmetric but has a reduced curvature. The curvature of the electrostatic lens changes corresponding to the cathode potential. Accordingly, with the changes in the curvature, the trajectories of the electron beams change. The changes of the curvature of the electrostatic lens act such that the displacement of the electron beam trajectory caused by repulsion is canceled. So, it is possible to correct misconvergence caused when the luminance changes, i.e., the amperage of a beam current changes.

BRIEF DESCRIPTION OF THE DRAWINGS

FIG. 1A is a schematic diagram showing an arrangement of a prior-art electron gun of a system in which electron beams are intersected with each other within the electron gun;

FIG. 1B is a schematic cross-sectional view of a prior-art electron gun of a system in which electron beams are not intersected with each other within the electron gun;

DESCRIPTION OF THE PREFERRED EMBODIMENTS

Figure 2:
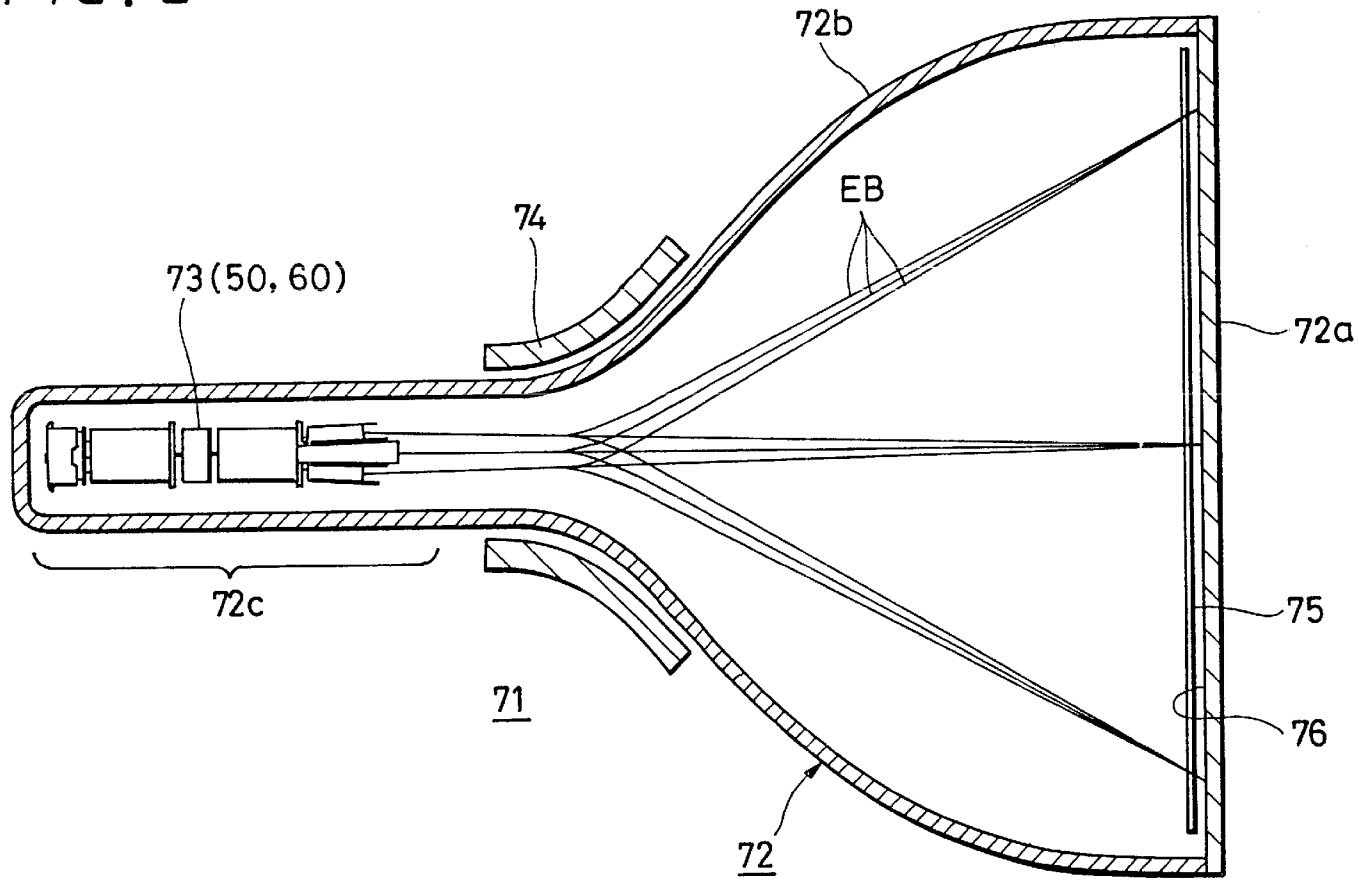
FIG. 2 is a cross-sectional view of a cathode-ray tube and illustrates the internal structure of the cathode-ray tube and the trajectories of electron beams.
Figure 3A:
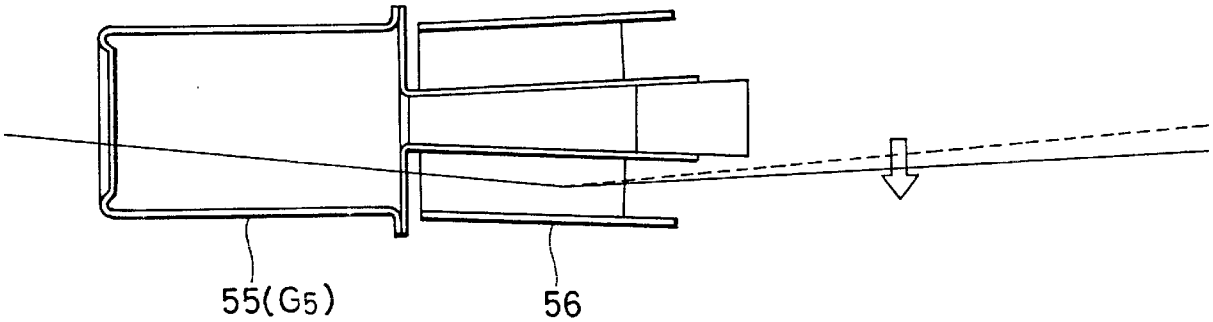
FIG. 3A is a diagram to which reference will be made in explaining the manner in which the trajectories of side beams are changed as the velocity of the electron beam increases in the electron gun of the system in which electron beams are intersected with each other within the electron gun.
Figure 3B:
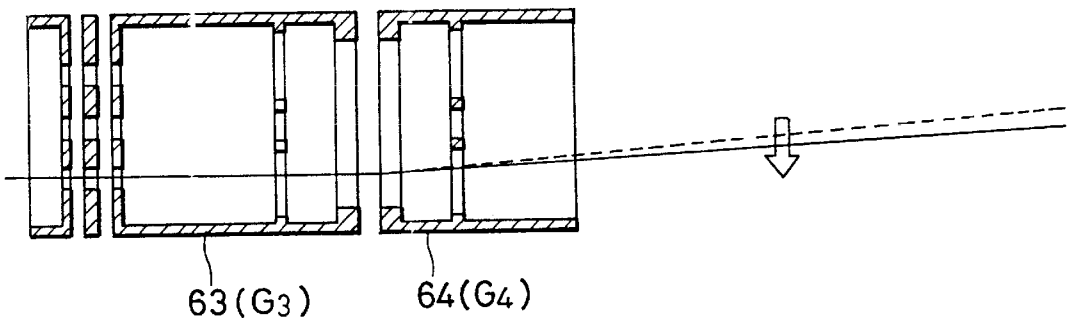
FIG. 3B is a diagram to which reference will be made in explaining the manner in which the trajectories of side beams are changed as the velocity of the electron beam increases in the electron gun of the system in which electron beams are not intersected with each other within the electron gun.
Figure 4:
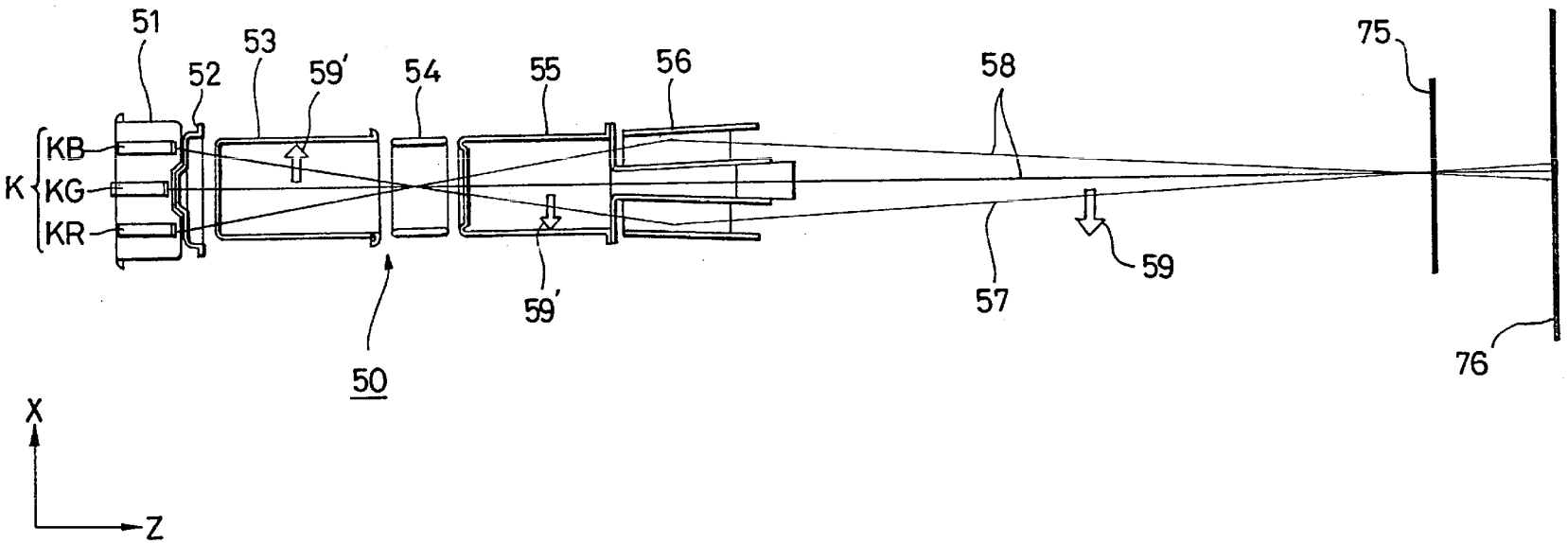
FIG. 4 is a diagram to which reference will be made in explaining a repulsion action effected on electron beams in the electron gun of the system in which electron beams are intersected with each other within the electron gun.
Figure 5:
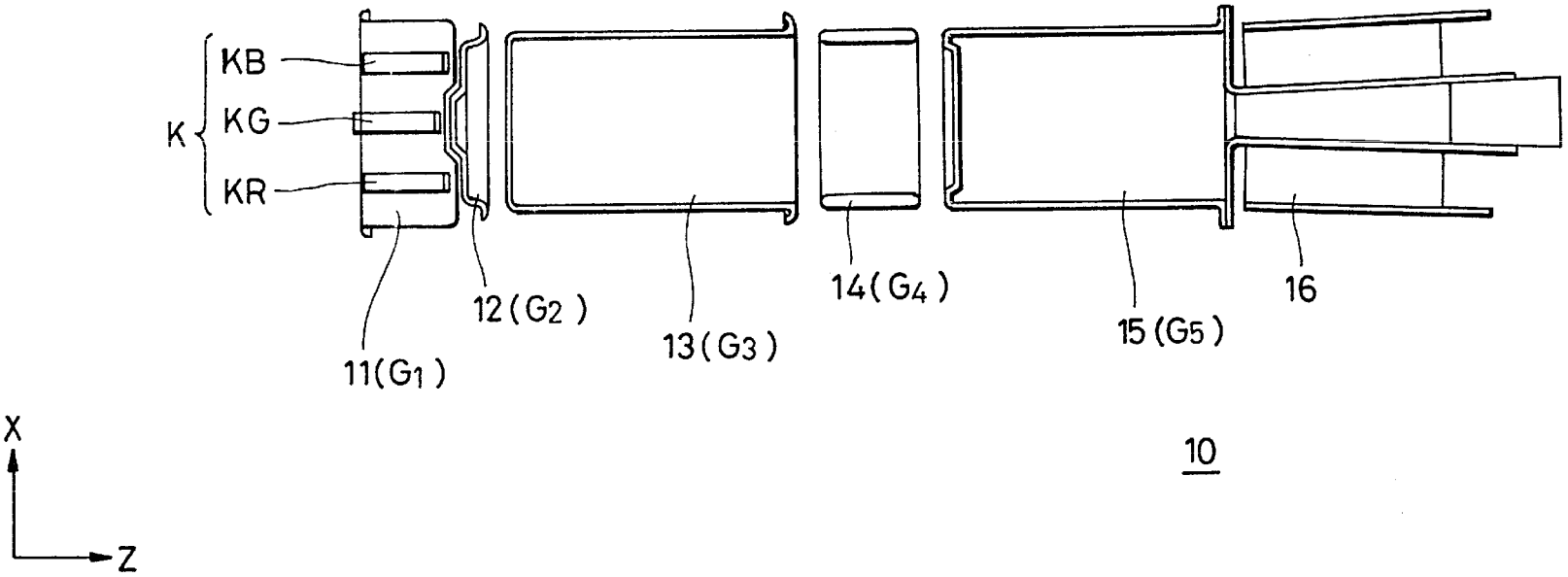
FIG. 5 is a schematic diagram of an arrangement of a cathode-ray tube electron gun used in the present invention and to which reference will be made in explaining the layout of a cathode and respective electrodes.

FIG. 5 is a schematic diagram showing an arrangement of an electron gun according to an embodiment of the present invention This electron gun 10 has a cathode group K including three cathodes KB, KG, KR corresponding to blue, green and red displays respectively. This electron gun 10 also includes respective electrodes arrayed substantially coaxially, i.e., a first electrode 11 (G1), a second electrode 12 (G2), a third electrode 13 (G3), a fourth electrode 14 (G4), a fifth electrode (G5) and a convergence plate 16.

The cathode K, the first electrode 11 (G1) and the second electrode 12 (G2) are designed such that their central portions corresponding to the cathode KG for displaying green and their outside portions are laid in parallel to each other and have differences in level.

This electron gun 10 has the arrangement substantially similar to that of the color, cathode-ray-tube electron gun 50 shown in FIG. 1A.

Figure 6:
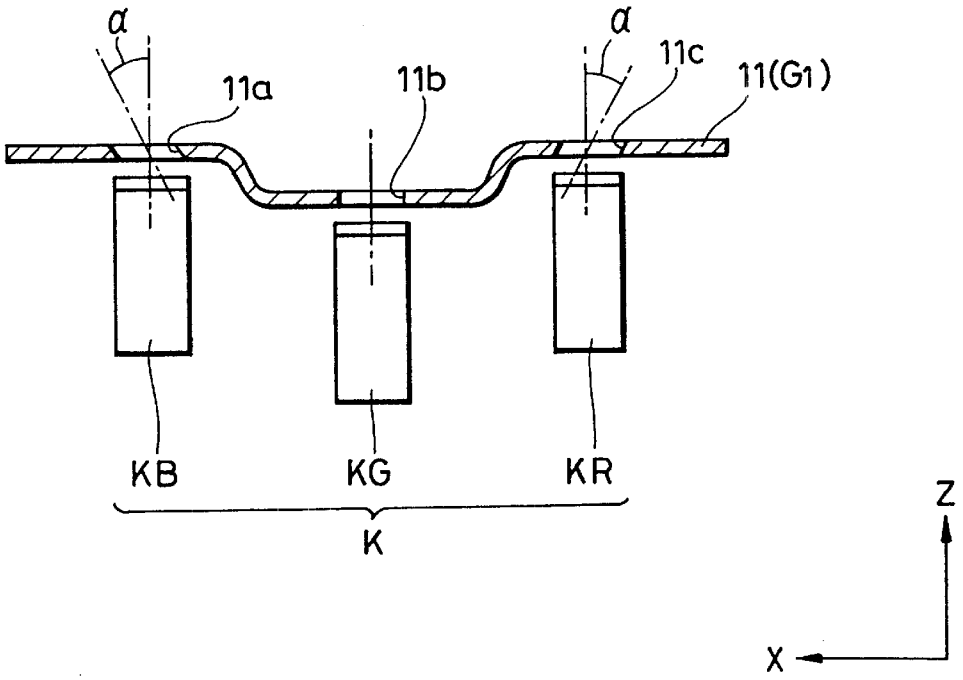
FIG. 6 is a partly-enlarged, cross-sectional view of the cathode and the first electrode in the cathode-ray-tube electron gun shown in FIG. 5 and to which reference will be made in explaining the state in which the axes of apertures 11*a*, 11*c* bored through an electrode 11 are inclined relative to the axes of respective cathodes KB, KR by an angle $\alpha$.

FIG. 6 is a partly-enlarged, cross-sectional view of the cathode K and the first electrode 11 in the electron gun 10 shown in FIG. 5.

In this embodiment, in the first electrode 11 (G1), apertures 11*a* and 11*c* opposing to the two side cathodes KB and KR and through which two side electron beams (side beams) pass are provided. These apertures are inclined by a predetermined angle a relative to the normal line direction of the cathodes KB, KR, i.e., tube axis direction Z, in such a manner that those apertures may come away from the axis of the electron gun outwardly as seen from the cathode K side.

On the other hand, an aperture 11*b* opposing to the central cathode KG is formed in the first electrode 11 (G1). This aperture is formed along the normal line direction of the cathode K, i.e., the tube axis direction Z.

Since the first electrode 11 (G1) has the above-described arrangement, an electrostatic lens formed between the cathode KB, cathode KR and the first electrode 11 (G1) is formed as an axial asymmetric electrostatic lens.

Figure 7:
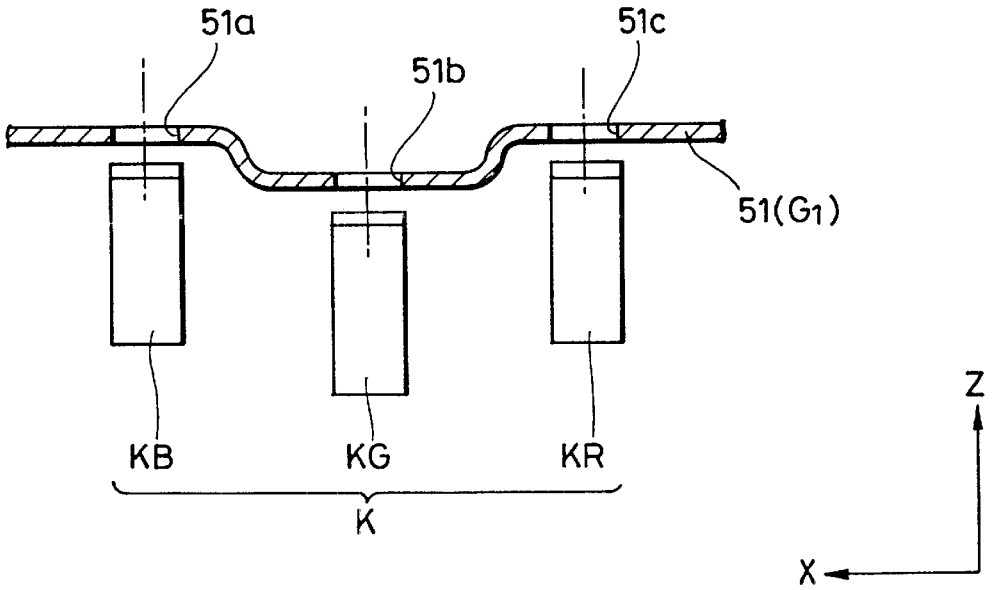
FIG. 7 is a partly-enlarged, cross-sectional view of the cathode and the first electrode in the electron gun shown in FIG. 1A and to which reference will be made in explaining the state in which the axes of apertures 51*a*, 51*c* bored through the electrode 51 are not inclined relative to the axis of the cathode.

This axial-asymmetric electrostatic lens can change the trajectories of the side beams in response to the change of the luminance, i.e., the change in the current and the cathode potential As a comparison, FIG. 7 shows a partly-enlarged, cross-sectional view of the cathode K and the first electrode 51 (G1) of the electron gun 50 of the conventional system shown in FIG. 1A.

In this case, three electron-beam apertures 51*a*, 51*b*, 51*c* of the first electrode 51 (G1) are all formed along the normal line direction of the cathode surface of the cathode K (KB, KG, KR), i.e. the tube axis direction Z.

The electron gun 10 according to this embodiment can correct a convergence change as the luminance is changed in the conventional arrangement shown in FIG. 7.

In FIG, 6, the above-described apertures 11*a*, 11*c* inclined with respect to the normal line direction of the cathodes KB, KR, i.e., the tube axis direction Z, can be formed in such a manner that the apertures are directly bored obliquely through the first electrode 11 (G1) by a suitable method, such as press-treatment or drill-treatment, after the first electrode 11 (G1) had been formed such that the central portion and the two side portions may become parallel to each other and may have differences in level.

Figure 8A:
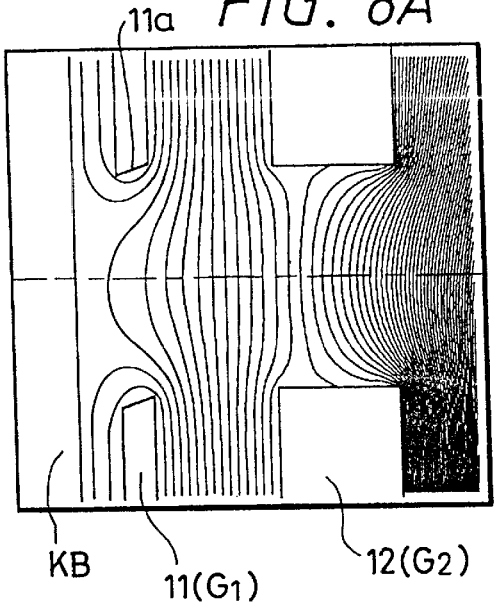
FIG. 8A is a diagram showing the cathode KB, the electrode 11 and the portion near the electrode 12 in the cathode-ray-tube electron gun shown in FIGS. 5 and 6 and showing a potential distribution obtained when the cathode KB is held at a high potential and the amperage of the beam current is small.
Figure 8B:
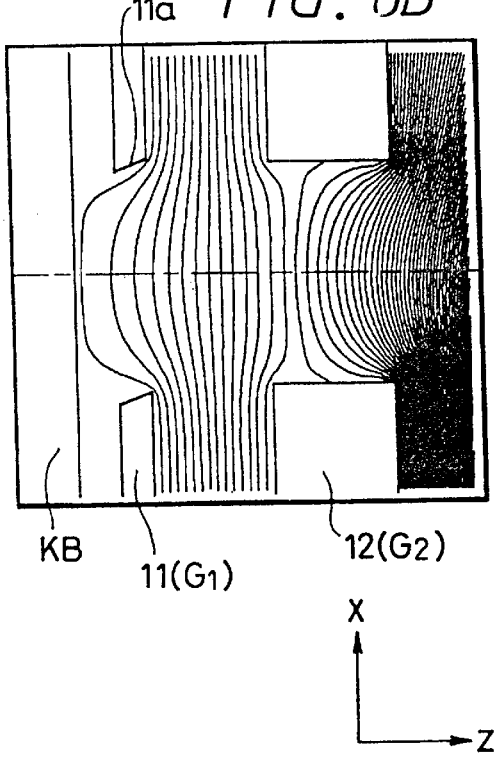
FIG. 8B is a diagram showing the cathode KB, the electrode 11 and the portion near the electrode 12 in the cathode-ray-tube electron gun shown in FIGS. 5 and 6 and showing a potential distribution obtained when the cathode KB is held at a low potential and the amperage of the beam current is large.

FIGS. 8A and 8B show a relationship between current amperage and a potential distribution near the first electrode 11 (G1) in the color cathode-ray tube electron gun 10 shown in FIGS. 5 and 6.

FIGS. 8A and 8B show potential distributions of the cathode KB for displaying blue and at the portion through which the electron beam passes. In the figures, dashed lines show the center axes of the apertures.

An action for changing the trajectories of the side beams in the electron gun 10 according to this embodiment will be described with reference to FIGS. 8A and 8B.

First, when a luminance is low, i.e., a cathode potential is held at high level and current amperage is held at low level, an axial-asymmetric electrostatic lens having a large curvature is formed relative to the beam emitting position of the cathode so that the side beams travel to the outside relative to the axis of the electron gun 10, i.e. to the lower part of the drawing.

In FIG. 8A, although an electric field between the cathode KB for diplaying blue and the first electrode 11 (G1) is generated in the direction perpendicular to the potential distribution, since the electron-beam aperture 11*a* is formed with the inclination, the potential distribution becomes asymmetric relative to the axis, i.e., the potential distribution becomes a distribution deviated from the axis to the lower direction in the sheets of drawing. Further, since the cathode potential is high, the axial-asymmetric degree of the potential distribution relative to the axis increases so that an axial-asymmetric electrostatic lens having a large curvature is formed.

In this case, since the influence of the axial-asymmetric electric field is exerted upon the portion near the center of the electron-beam aperture 11*a*, the blue electron beam is deflected toward the outside with respect to the axis, i.e., toward the lower part of the drawing.

On the other hand, when the luminance is high, i.e., the cathode potential is low and the amperage of the current is large, since the curvature of the axial-asymmetric electric field electrostatic lens) is reduced, the side beams pass through the trajectories near the axis of the electron gun 10, as compared with the case in which the amperage of the current is small.

Specifically, as shown in FIG. 8B, the cathode potential is low and hence the curvature of the axial-asymmetric electric field (electrostatic lens) is reduced.

The potential distribution also has a smaller axial-asymmetric degree, and hence the axial-asymmetric electric field becomes difficult to influence the portion near the center of the electron beam aperture 11*a*.

As a result, the blue electron beam is not deflected so much and is passed through the trajectory close to the axis.

That is, when the amperage of the beam current is small, the trajectory change by the repulsion is small; however, the asymmetric electrostatic lens affects the electron beam for displaying blue in such a manner that it is bent toward the outside with respect to the axis, i.e., toward the lower part of the drawing.

On the other hand, when the amperage of the beam current is large, the trajectory change by the repulsion increases. However, the above-mentioned effect of the asymmetric-electrostatic lens becames weaker, so that the degree of bending the electron beam toward the lower part of the drawing becomes less.

The electron-beam trajectory change caused by the change in the electrostatic-lens effect acts to cancel the the trajectory change by the repulsion.

Accordingly, if the cathode-ray tube is adjusted in such a manner that an optimum convergence may be obtained in the state in which the amperage of the beam current is small, then even when the amperage of the beam current increases, constant convergence characteristics can be maintained.

Figure 9A:
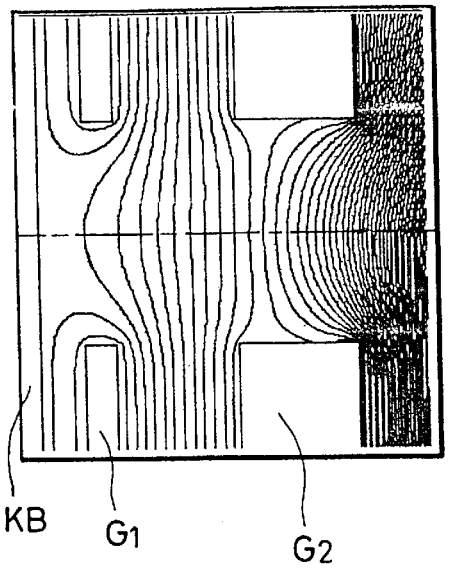
FIG. 9A is a diagram showing the cathode KB, the electrode G1 and the portion near the electrode G2 in the prior-art cathode-ray-tube electron gun and showing a potential distribution obtained when the cathode KB is held at a high potential and the amperage of the beam current is small.
Figure 9B:
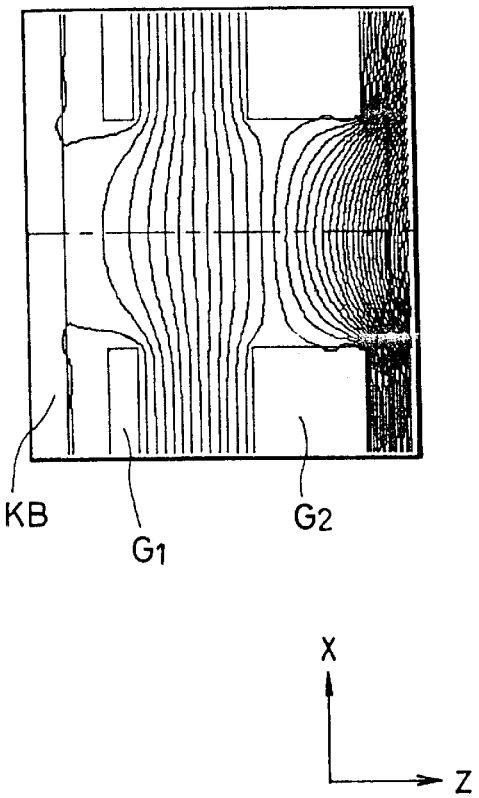
FIG. 9B is a diagram showing the cathode KB, the electrode G1 and the portion near the electrode G2 in the prior-art cathode-ray-tube electron gun and showing a potential distribution obtained when the cathode KB is held at a low potential and the amperage of the beam current is large.

As a comparison, FIG. 9 shows a relationship between the amperage of the current and the potential distribution near the first electrode G1 in the conventional electron gun 50 or 60 shown in FIG. 1A or 1B. FIG. 9A shows a potential distribution obtained when the amperage of the current is small, and FIG. 9B shows a potential distribution obtained when the amperage of the current is large.

In this case, since the electron-beam aperture of the first electrode G1 is formed along the normal line direction of the cathode surface, the potential distribution is the axisymmetric potential distribution regardless of the amperage of the current, and hence an axial-symmetric electrostatic lens is formed.

Owing to this axisymmetric electrostatic lens, electron beams are emitted to the normal line direction of the cathode surface.

Referring to a thesis (ASIA DISPLAY 95, p760 to 770) by WADA et al., the changed amount of the misconvergence is approximately calculated by using the value of the distance between electron beams in the convergence plate portion 16, the value of the distance up to the screen (fluorescent screen) and the value of the anode accelerating voltage.

Figure 10:
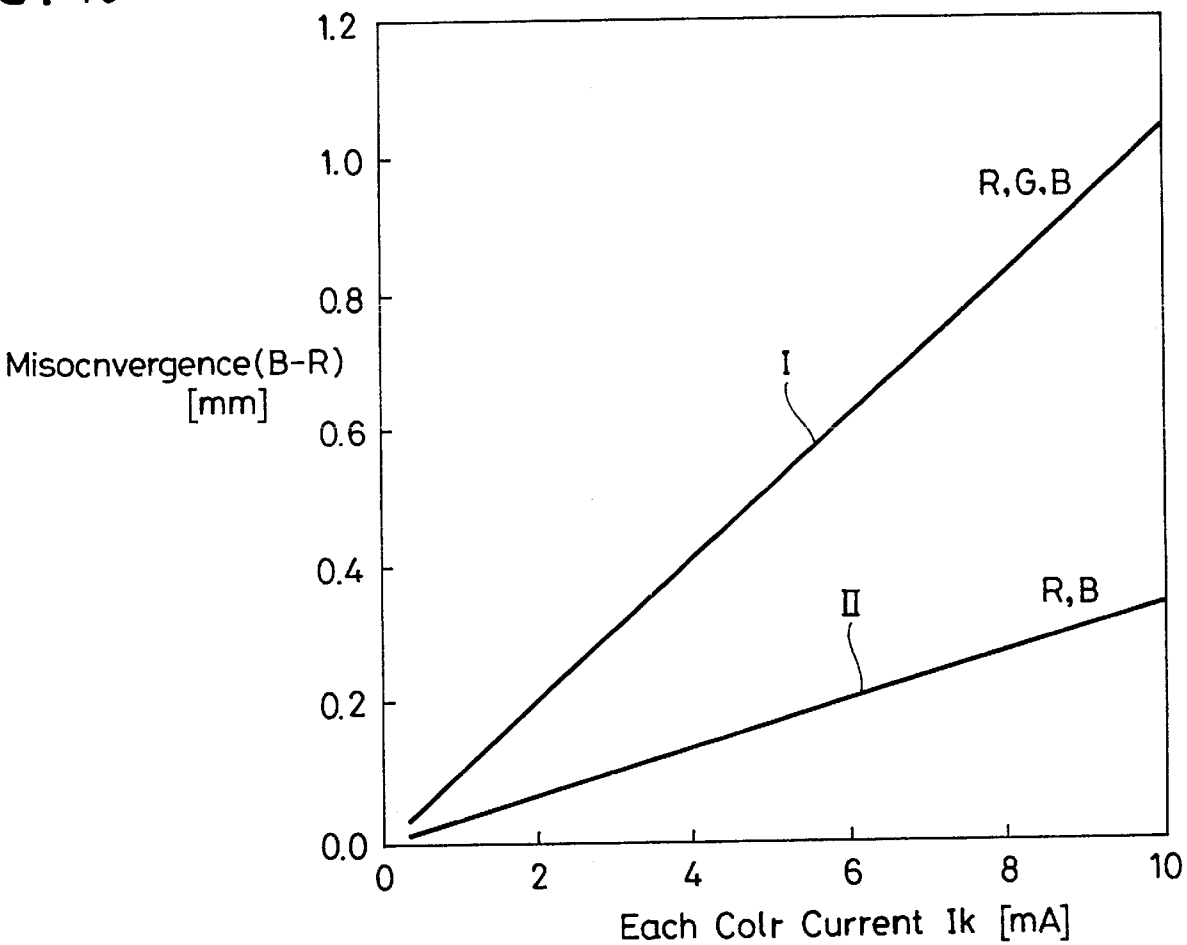
FIG. 10 is a diagram showing the manner in which the amount of the misconvergence is changed as the amperage of the electron-beam current is changed in the prior-art electron gun.

FIG. 10 is a characteristic diagram showing measured results of a misconvergence amount changed when the amperage of the current is changed in the conventional electron gun.

The amounts of the misconvergence were measured while the amperage of a current value Ik was being changed where the distance between the electron beams in the convergence plate portion 16 was 5 mm, the distance up to the screen (fluorescent screen) was 280 mm and the value of the anode accelerating voltage was 30 kV.

A characteristic line I in the figure shows the misconvergence amount between two side beams for displaying blue and red measured when three electron beams for displaying red, green and blue are emitted at respective current values Ik (mA) on the horizontal axis.

A characteristic line II shows the misconvergence amount between side beams measured when the current in the center electron beam for displaying green was stopped and only two side beams for displaying blue and red are emitted at respective current values Ik (mA)The The misconvergence amount (mm) is normalized to 0 mm when the current value Ik =0 mA.

A study of FIG. 10 reveals that, when the three electron beams are emitted, the misconvergence was caused by the repulsion action from the other two electron beams and the misconvergence amount increases in proportion to the current value Ik.

It is also to be understood that, when the emission of the center electron beam of the green G is stopped, the repulsion action from the green electron beam G is lost and only the repulsion action from the other side beams is caused so that the misconvergence amount of the side beams decrease.

When only one electron beam is emitted, no repulsion action is caused so that the misconvergence not substantially caused. Therefore, the trajectory of the electron beam can be kept in the state presented when the current value Ik =0 mA.

In order to execute the optimum correction on the change of the trajectories of the side beams, there should be considered various parameters such as the setting of a cut-off voltage of a cathode, the necessary drive voltage, the structure of an electron gun, and the repulsion effect caused by necessary current amperage.

In the electron gun 10 according to this embodiment, when the inclination angle a of the side beam apertures 11*a*, 11*c* of the first electrode 11 (G1) is set based on the above various parameters, the change of the trajectories of the side beams can be corrected optimally.

Therefore, the misconvergence caused in the conventional arrangement shown in FIG. 10 can be eliminated substantially, and hence the electron beams can be converged at the same positions as those obtained when the current value Ik =0.

In the electron gun of the system in which beams intersect each other in the electron gun for use in a flat-panel cathode-ray-tube, for example, if the inclination angle $\alpha$=20°, then the change of the convergence caused by the aforementioned electric field and repulsion action or the like can be canceled completely.

Figure 11:
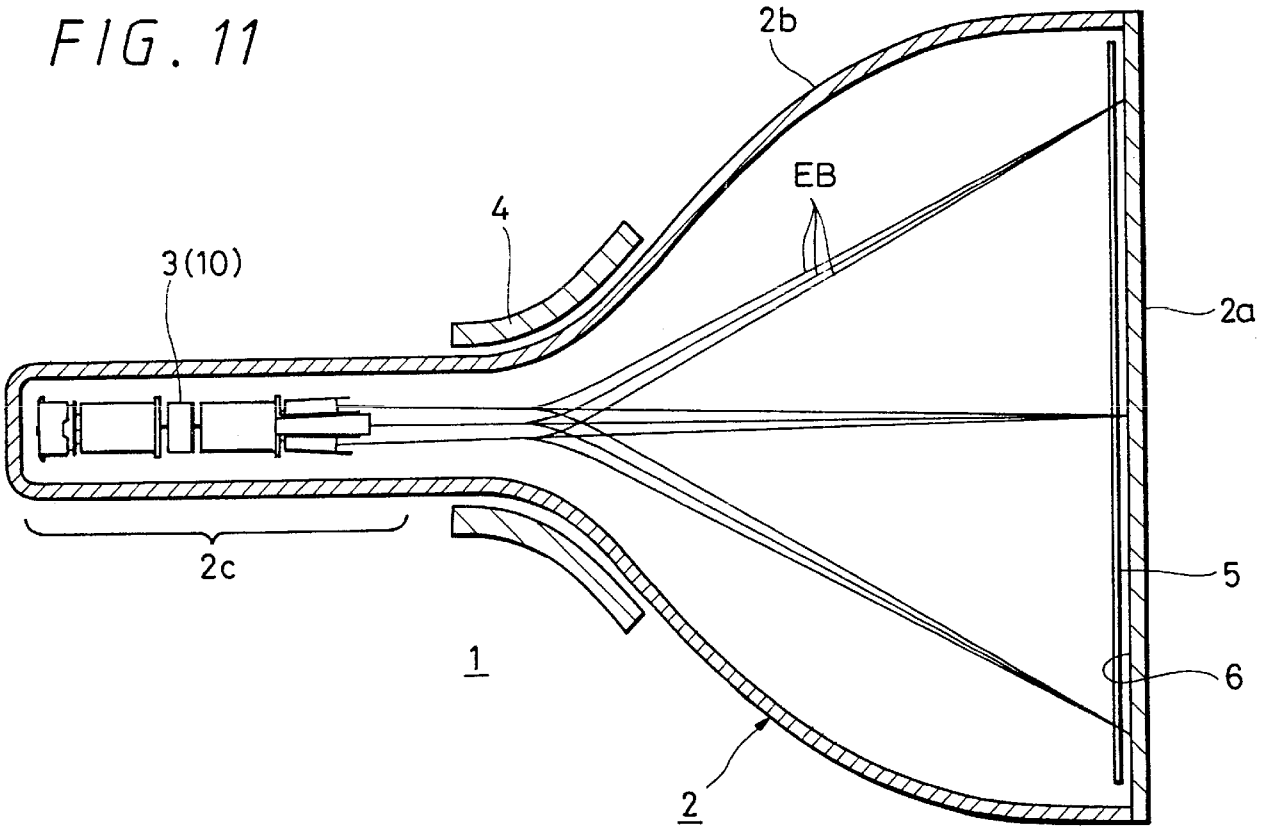
FIG. 11 is a diagram showing the inside of the cathode-ray tube including the cathode-ray-tube electron gun shown in FIG. 5.

A color cathode-ray tube can be comprised of this color cathode-ray tube electron gun 10. FIG. 11 is a diagram showing the inside of the cathode-ray tube including the color cathode-ray tube electron gun 10 shown in FIG. 5.

This cathode-ray tube 1 is formed of a cathode-ray tube assembly 2 made of a glass bulb, for example. This cathode-ray tube assembly 2 includes a panel portion 2*a* in which there is formed a fluorescent screen 6 on which phosphors are coated in a stripe fashion. A color-selecting mechanism 5 having openings through which electron beams pass is disposed in an opposing relation to the fluorescent screen 6. A deflection yoke 4 is disposed outside the side of a necked-down portion 2*c* of the funnel portion 2*b* of the cathode-ray tube assembly 2. The electron gun 10 having the arrangement shown in FIGS. 5 and 6 is disposed within the neckeddown portion 2*c* of the cathode-ray tube assembly 2 as an electron gun 3.

The electron gun 3 (10) has the above arrangement, and the amount in which the trajectories of electron beams EB are displaced due to the electrostatic field caused when the luminance is changed and due to the repulsion action can be corrected in advance. Acordingly, the picture quality deterioration, such as the color shading caused by the misconvergence caused when the luminance is changed, can be reduced, and hence a picture having an excellent picture quality can be obtained.

The method of forming the inclined apertures 11*a*, 11*c* through which the side beams pass is not limited to the above method in which the inclined apertures are directly bored through the first electrode G1 by a suitable means, such as press-treatment or drill-treatment.

For example, there can be used another method in which the opening portion is formed by stacking and sticking thin plates with apertures of the same size bored thereon while the positions of the apertures are being shifted little by little. Also in this case, there can be achieved effects equivalent to those achieved when the inclined apertures are directly bored through the first electrode.

Specifically, it is sufficient that the opening portion may be inclined substantially with respect to the normal line direction of the cathode.

According to the above-described embodiment of the present invention, since the side-beam apertures 11*a*, 11*c* of the first electrode 11 (G1) of the electron gun 10 are inclined relative to the normal line direction of the cathode, the axial-asymmetric electric field is formed between the cathode K and the first electrode 11 (G1), and the curvature of this axial-asymmetric electric field is changed by the change of the beam current, i.e., the cathode potential, whereby the trajectories of the electron beams can be shifted automatically in the direction in which the change of the convergence can be corrected.

Consequently, without considering the correction by using the external circuit and the follow-up property of the signal, there can be obtained an excellent convergence characteristic in all the luminance and all cathode current regions.

Moreover, since a new electrode need not be added, an external correction means need not be used, and the number of assemblies should not increase, and the above effects can be achieved without increasing the manufacturing cost too much.

Figure 12:
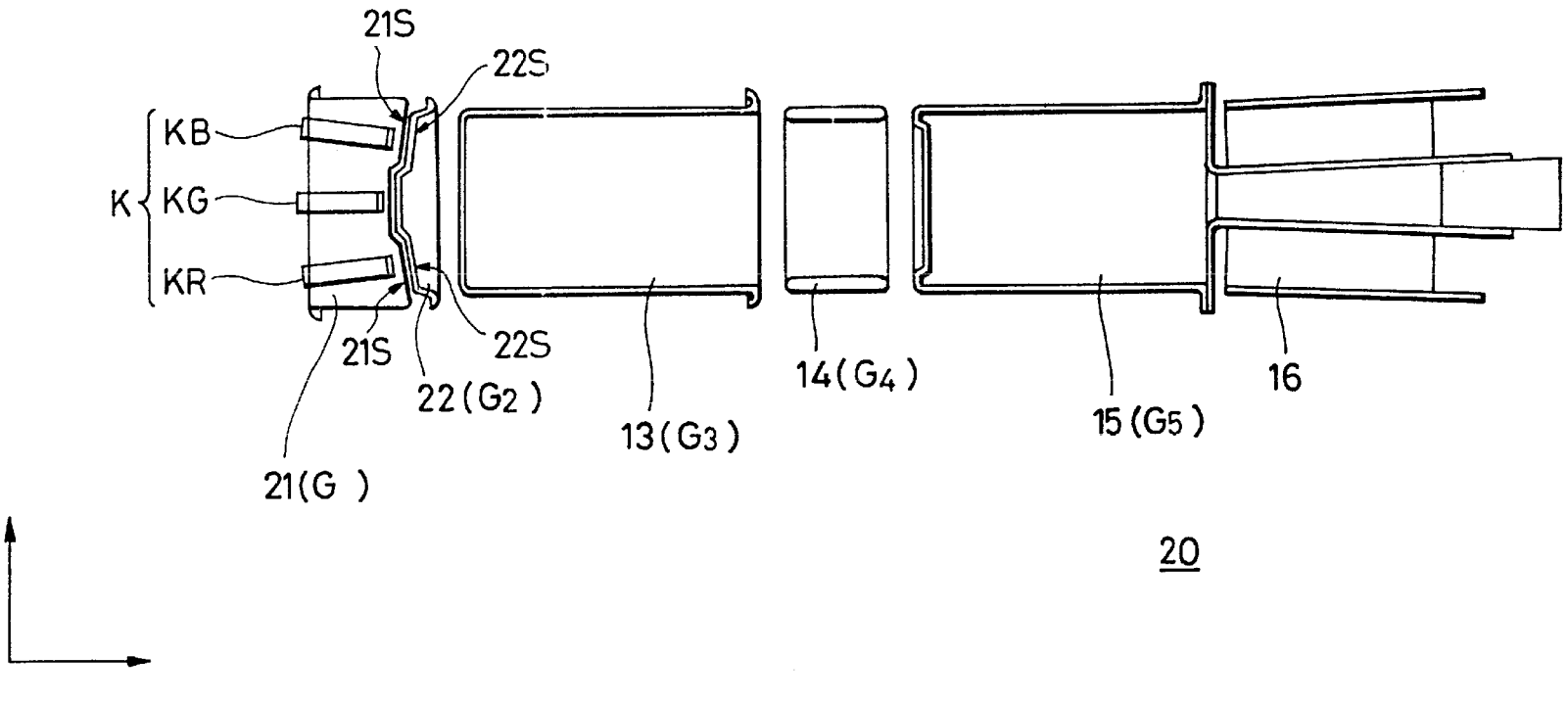
FIG. 12 is a schematic diagram showing an arrangement of a cathode-ray-tube electron gun according to another embodiment of the present invention and to which reference will be made in explaining the layout of a cathode and respective electrodes.

Subsequently, FIG. 12 is a schematic diagram showing an arrangement of a color cathode-ray-tube electron gun according to another embodiment of the present invention.

This color cathode-ray-tube electron gun 20 is an electron gun of a system similar to the electron gun 10 shown in FIG. 5.

In the electron gun 20 according to this embodiment, in particular, a first electrode 21 (G1) and a second electrode 22 (G2) include inclined surfaces 21S, 22S that are formed by inclining portions through which side beams pass inwardly toward the axis of the electron gun 20 from the central portion through which a center electron beam passes.

Then, two side cathodes KB, KR are disposed in accordance with the inclination of the first electrode 21 (G1) in such a manner that the surfaces in which the cathodes KB, KR and the first electrode 21 (G1) are opposed to each other are parallel to each other. This arrangement will be referred below to as an "inclined cathode".

Figure 13:
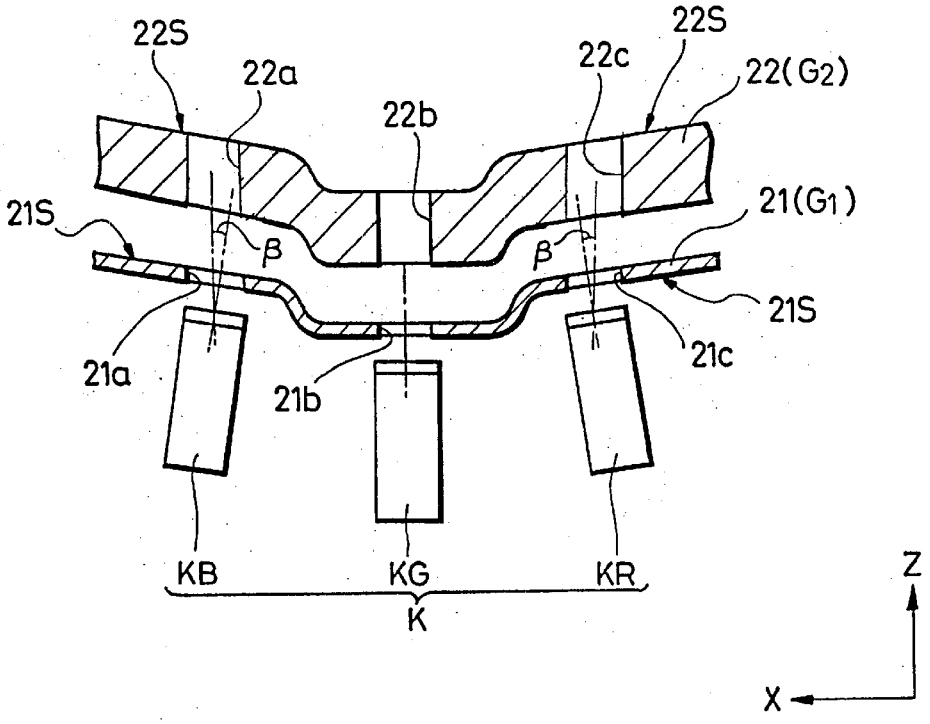
FIG. 13 is a partly-enlarged, cross-sectional view of a cathode, a first electrode and a second electrode of the cathode-ray-tube electron gun shown in FIG. 12.

FIG. 13 is a partly-enlarged, cross-sectional view of the cathode K, the first electrode 21 and the second electrode 22 in the electron gun 20 shown in FIG. 12.

According to this embodiment, the first electrode 21 (G1) and the second electrode 22 (G2) include three electron-beam apertures 21*a*, 21*b*, 21*c*, which are bored in parallel to the tube axis direction Z of the electron gun 20.

Consequently, in actual practice, the side-beam apertures 21*a*, 21*c* and 22*a*, 22*c* of the first electrode 21 (G1) and the second electrode 22 (G2) have shapes perpendicular to the electrode surfaces, and i.e., inclined surfaces 21S, 22S, i.e., cross-sectional shapes inclined relative to the normal line direction of the cathode surface.

Accordingly, similarly to the electron gun 10 according to the previous embodiment, the axial-asymmetric electric field is formed between the cathode K and the first electrode 21 (G1). The curvature of this axial-asymmetric electric field is changed by the change of the beam current, i.e., the cathode potential, whereby the trajectories of the electron beams can be shifted automatically in the direction in which the change of the repulsion can be corrected.

Respective electrodes following the third electrode G3 are similar to those of the color cathode-ray-tube electron gun 10 shown in FIG. 5. Therefore, they are identified with identical reference numerals and need not be described.

In the electron gun 10 according to the previous embodiment, when the side beam apertures 11*a*, 11*c* are bored by the presstreatment, for example, the central electron-beam aperture 11*b* should be bored in the vertical direction. However, the side-beam apertures should be bored with inclinations, and hence the punching direction also should be inclined, which makes mass-production of electron guns difficult.

On the other hand, in the electron gun 20 according to this embodiment, since the three apertures 21*a*, 21*b*, 21*c* of the first electrode 21 are all arrayed in the direction parallel to the tube axis direction Z, after the inclined surface 21S had been formed on the first electrode 21 in advance, the three apertures 21*a*, 21*b*, 21*c* can all be punched in the vertical direction by press. There is then the advantage that the press-treatment becomes easy.

Apart from the advantage of easy press-treatment, in order to optimize the correction of the misconvergence, the inclination angle (may be increased or decreased by further inclining the side-beam apertures 21*a*, 21*c* from the tube axis direction Z.

In the electron gun 20 according to this embodiment, since the two side portions of the cathode K, the first electrode 21 (G1) and the second electrode 22 (G2) are inclined relative to the central portion, as compared with the case in which the above two side portions are not inclined, the lens effect formed by the second electrode 22 (G2) and the third electrode 13 (G3) can be changed.

As a consequence, when the inclination angle of the aperture of the first electrode 21 (G1) in the electron gun 20 according to this embodiment is set to $\beta=7.85°$, there can be achieved a correction effect equivalent to that achieved when the inclination angle of the aperture of the first electrode 11 (G1) in the electron gun 10 according to the previous embodiment is set to $\alpha=20°$.

Accordingly, in the electron gun 20 according to this embodiment and the electron gun 10 according to the previous embodiment, the inclination angles ($\alpha$and $\beta$) for achieving the equivalent correction effects are not always coincident with each other.

According to the above embodiment, since the side-beam apertures 21*a*, 21*c* of the first electrode 21 (G1) are inclined relative to the normal line direction of the cathode surfaces of the opposing cathodes KB, KR, similarly to the previous embodiment, it becomes possible to automatically shift the trajectories of the beams to the direction in which the deterioration of the convergence can be corrected.

Also in this embodiment, cathode-ray-tube 1 can be formed by using the electron gun 20 shown in FIGS. 12 and 13 as the electron gun 3 of the cathode-ray tube 1 shown in FIG. 11.

Consequently, the misconvergence caused by the change of the luminance can be decreased, and hence a picture having an excellent picture quality can be obtained.

Figure 14:
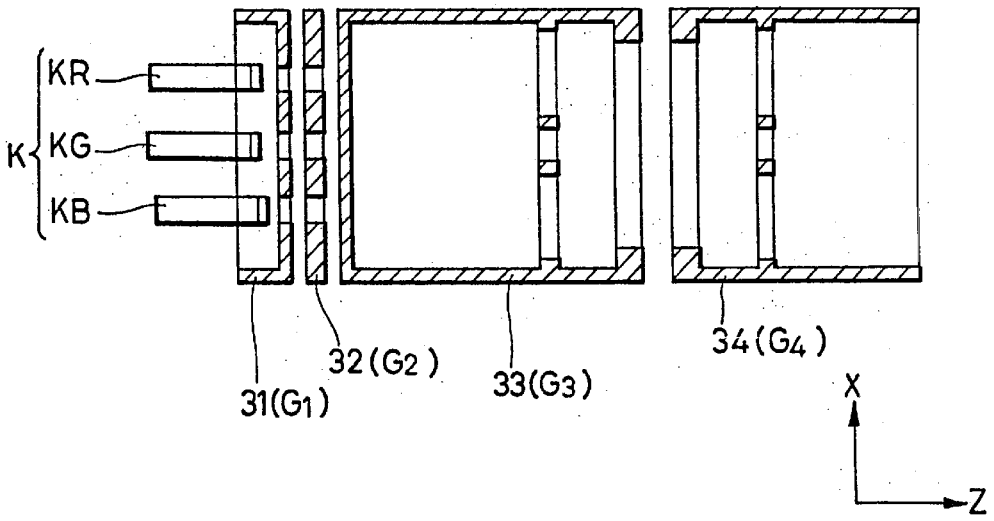
FIG. 14 is a schematic diagram showing an arrangement of a cathode-ray-tube electron gun according to another embodiment of the present invention and to which reference will be made in explaining the layout of the cathode and the respective electrodes.

FIG. 14 is a schematic cross-sectional view showing a color cathode-ray-tube electron gun according to a further embodiment of the present invention.

This color cathode-ray-tube electron gun 30 is an electron gun of a system in which a plurality of electron beams becomes substantially parallel and is comprised of a cathode K and respective electrodes substantially arrayed in line, i.e., a first electrode 31 (G1), a second electrode 32 (G2), a third electrode 33 (G3) and a fourth electrode 34 (G4).

This electron gun 30 has a schematic arrangement similar to that of the color cathode-ray tube electron gun 60 shown in FIG. 1B.

Figure 15:
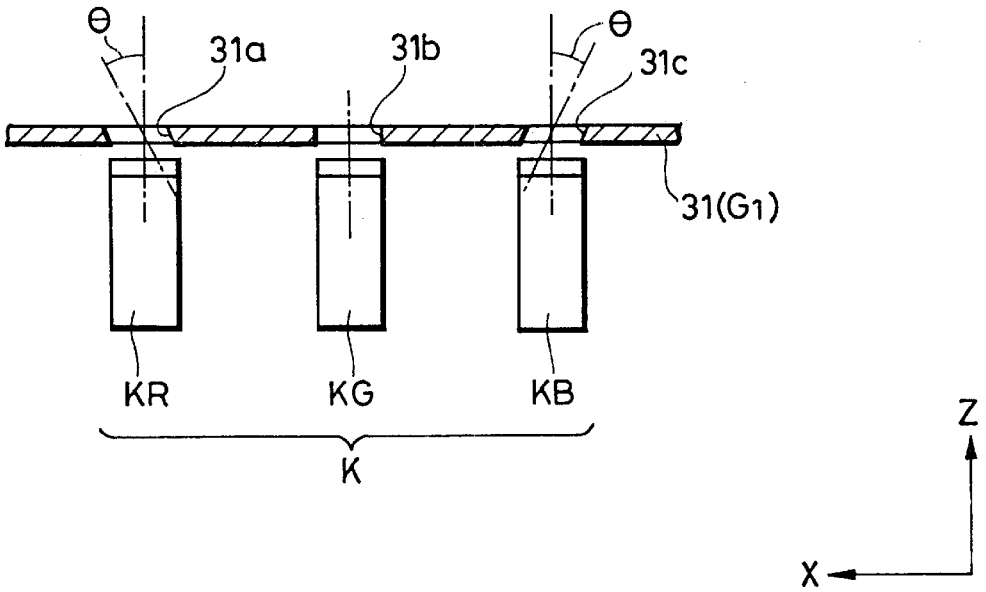
FIG. 15 is a partly-enlarged, cross-sectional view of the cathode and the first electrode in the cathode-ray-tube electron gun shown in FIG. 14 and to which reference will be made in explaining the state in which the axes of apertures 61*a*, 61*b* bored through an electrode 61 are inclined relative to the axis of the cathode.

FIG. 15 is a partly-enlarged, cross-sectional view of the cathode K and the first electrode 31 in the color cathode-ray-tube electron gun 30 shown in FIG. 14.

As shown in FIG. 15, in the first electrode 31, apertures 31*a* and 31*c* opposing to the two outside cathodes KR and KB are outwardly inclined by a predetermined inclination angle $\theta$ relative to the normal line direction of the cathode surfaces of the cathodes KR, KB, i.e., the tube-axis direction Z as seen from the cathode K side.

On the other hand, an aperture 31*b* opposing to the central cathode KG is bored along the normal line direction of the cathode surface of the cathode KG, i.e., the tube-axis direction Z.

The electron gun of the system in which a plurality of electron beams are intersected and the electron gun of the system in which a plurality of electron beams become parallel are different in convergence-change sensitivity. So, the optimum inclination angles of the side-beam apertures of the first electrode G1 also are different from each other.

The electron gun of the system, as of the electron gun 30 according to this embodiment, has a low convergence-change sensitivity as compared with the electron gun of the system in which a plurality of electron beams are intersected. Accordingly, a correction can be sufficiently made when the inclination angle $\theta$=about 100.

Figure 16:
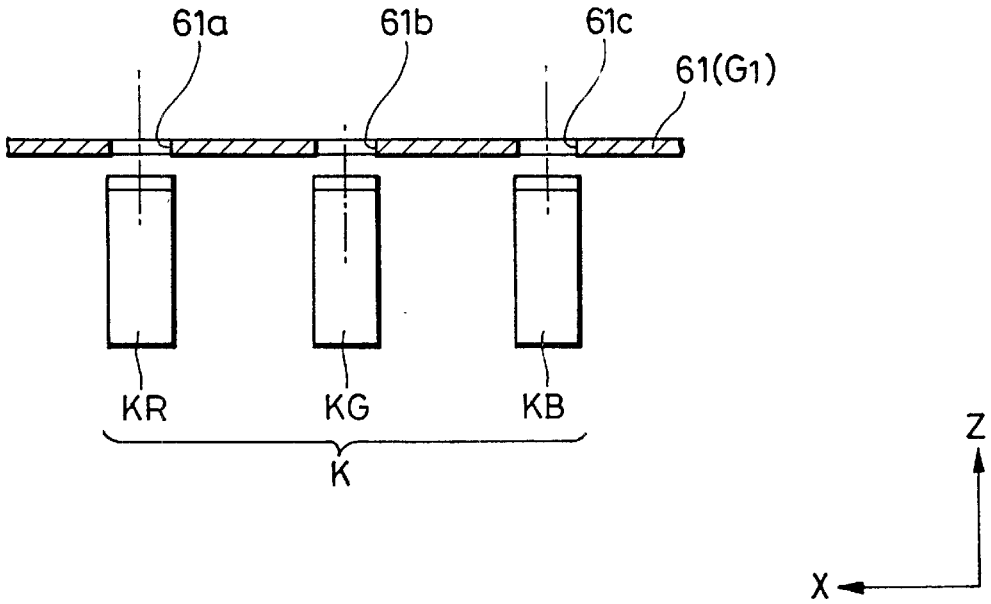
FIG. 16 is a partly-enlarged, cross-sectional view of the cathode and the first electrode in the prior-art electron gun shown in FIG. 1B and to which reference will be made in explaining the state in which the axes of the apertures 61*a*, 61*b* bored through the electrode 61 are not inclined relative to the axis of the cathode.

As a comparison, FIG. 16 is a partly-enlarged, cross-sectional view showing the cathode K and the first electrode 61 (G1) of the conventional electron gun 60 of the multi-beam multi-electron gun system shown in FIG. 1B.

In this case, the three electron-beam apertures 61*a*, 61*b*, 61*c* of the first electrode 61 (G1) are all bored along the normal line direction of the cathode surfaces of the cathode K (KR, KG, KB), i.e., the tube-axis direction Z.

The electron gun 10 according to this embodiment is able to correct the change of the convergence sensitivity caused when the luminance is changed in the conventional arrangement shown in FIG. 16.

According to the above embodiment of the present invention, the side-beam apertures 31*a*, 31*c* of the first electrode 31 (G1) are inclined relative to the normal line direction of the cathode surfaces of the opposing cathodes KR, KB. Accordingly, similarly to the previous embodiment, the trajectories of the beams can be shifted automatically in the direction in which the change of the convergence can be corrected.

Also, in accordance with this embodiment, cathode-ray-tube 1 can be formed by using the electron gun 30 shown in FIGS. 14 and 15 as the electron gun 3 of the cathode-ray tube 1 shown in FIG. 11.

Consequently, the misconvergence caused when the luminance is changed can be decreased, and hence there can be obtained a picture having an excellent picture quality.

The side-beam apertures are all inclined in the direction in which they come away from the axis of the electron gun as seen from the cathode K side in the above embodiments. However, in a compound-lens system in which a number of front lenses are disposed up to a main lens, for example, the direction is not always limited to the direction in which the side-beam apertures come away from the axis of the electron gun as seen from the cathode K side, and the side-beam apertures may be inclined in the direction in which they come closer to the axis of the electron gun depending on the characteristics.

The present invention is not limited to the above embodiments and can take various modifications without departing from the gist of the present invention.

According to the above-mentioned present invention, since the cathode-ray-tube includes the electron gun in which the electrostatic lens formed between the cathode and the first electrode is formed as the axial-asymmetric electrostatic lens, the convergence change caused when the luminance is changed in the cathode-ray tube can be decreased, and hence there can be obtained an excellent picture quality.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claimed is:

1. A cathode-ray tube including an electron gun for emitting a plurality of electron beams, wherein said electron gun includes a plurality of cathodes disposed in an inline fashion, said electron gun includes a first electrode opposed to said cathodes, said first electrode includes beam apertures corresponding to said respective cathodes and that, of said beam apertures, said beam apertures through which side beams pass are inclined relative to said cathodes by a predetermined angle.

2. A cathode-ray tube according to claim 1, wherein said electron gun is an electron gun of a system in which electron beams are intersected with each other within said electron gun.

3. A cathode-ray tube according to claim 1, wherein said electron gun is an electron gun of a system in which electron beams become substantially parallel to each other within said electron gun.

4. A cathode-ray tube according to claim 1, wherein said electron gun is disposed in such a manner that said respective electron gun is disposed in such a manner that, of said cathodes, cathodes for emitting side beams are inclined.

5. A cathode-ray tube according to claim 1, wherein said electron gun is disposed in such a manner that said cathodes for omitting side beams are inclined.

6. A cathode-ray tube according to claim 2, wherein said predetermined angle is approximately 20 degrees.

7. A cathode-ray tube according to claim 3, wherein said predetermined angle is approximately 10 degrees.

* * * * *